United States Patent [19]

Fitch

[11] 4,014,267

[45] Mar. 29, 1977

[54] CONVEYOR CHAIN STRUCTURE

[75] Inventor: Harold G. Fitch, Clarkston, Mich.

[73] Assignee: American Chain & Cable Company, Inc., Bridgeport, Conn.

[22] Filed: June 30, 1975

[21] Appl. No.: 591,873

Related U.S. Application Data

[63] Continuation of Ser. No. 378,506, July 12, 1973, abandoned.

[52] U.S. Cl. ..... 104/172 C; 198/730

[51] Int. Cl.[2] ..... B61B 13/00

[58] Field of Search ..... 198/171, 172, 174, 177 R, 198/177 T, 168; 104/172 R, 172 C, 172 S; 74/250 R, 250 C, 251 R, 251 C, 254

[56] References Cited

UNITED STATES PATENTS 2,095,022 10/1937 Bishop ..... 198/177 R 2,885,969 5/1959 Kay et al. ..... 104/172 S

*Primary Examiner*—Evon C. Blunk
*Assistant Examiner*—Joseph E. Valenza
*Attorney, Agent, or Firm*—Barnes, Kisselle, Raisch & Choate

[57] ABSTRACT

A conveyor structure including a power track on which a conveyor chain is supported and a free track along which free trolleys travel. The conveyor chain includes alternate center or main links that are pivotally interconnected by alternate pairs of side links through pivot pins. The construction of the links and pivot pins is such that the links and pivot pins can be disconnected without the use of tools. One of the lower links has a pusher dog thereon and is constructed and arranged to permit removal and assembly thereof without the use of tools with respect to the remainder of the chain.

8 Claims, 10 Drawing Figures

CONVEYOR CHAIN STRUCTURE

This is a continuation of application Ser. No. 378,506, filed July 12, 1973 now abandoned.

This invention relates to conveyors and particularly to conveyor chain structures.

BACKGROUND OF THE INVENTION

In conveyor systems such as overhead power and free conveyor systems and towline conveyor systems, conveyor chains are commonly provided for moving the carriers along a track which in the case of an overhead conveyor is a free track and in the case of a towline conveyor is the floor. In an overhead conveyor system, the wheeled carriers are moved along a free track by the conveyor which operates in a power track and has means thereon for engaging the carriers on the free track.

In the prior art, it has been common to provide a special link in the area where the pusher dog is positioned and the link is asembled to the remainder of the chain by utilizing special washers and bolts. This necessitates the use of tools for removal of the pusher dog link and, in addition, requires inventory of such additional parts. As far as I am aware, no one has ever designed a conveyor chain structure wherein the pusher dog forms a part of a link that can be assembled and dis-assembled without the use of tools in substantially the same manner as the links of the remainder of the chain.

Among the objects of the invention are to provide a conveyor system wherein the conveyor chain includes a link having a pusher dog thereon, which link is assembled and disassembled with respect to the remainder of the chain without the use of tools in substantially the same manner as the other links in the chain.

DESCRIPTION

Figure 2:
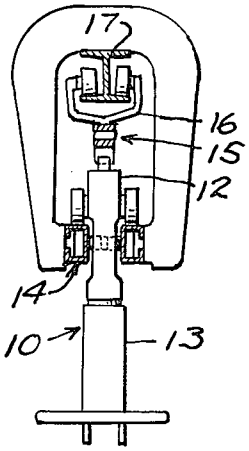
FIG. 2 is a sectional view taken along the line 2—2 in FIG. 1.
Figure 1:
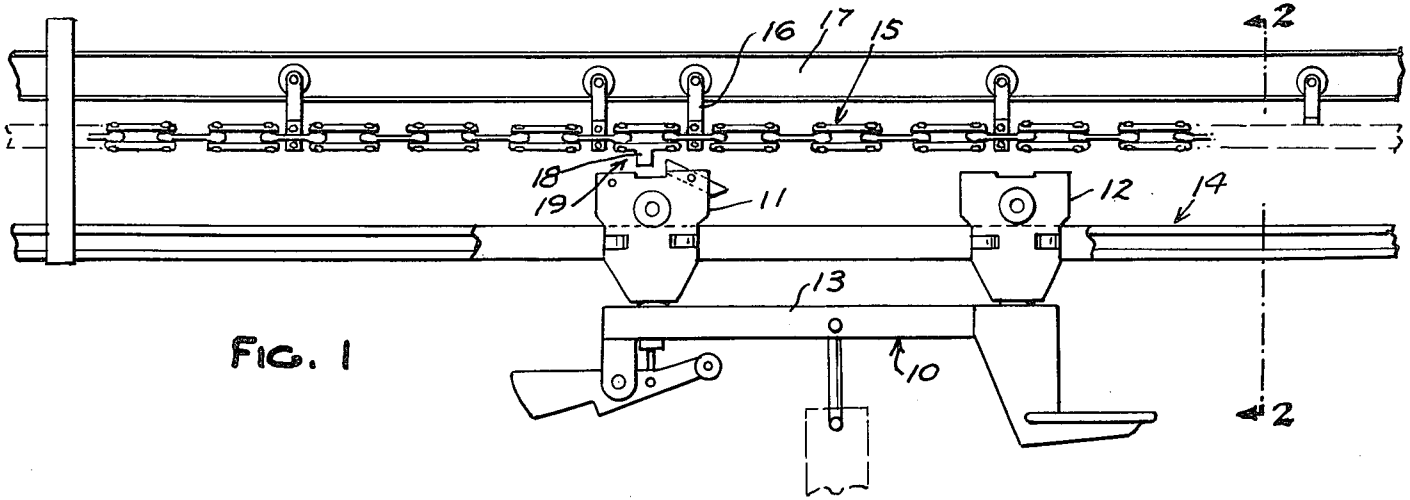
FIG. 1 is an elevational view of a power and free conveyor system embodying the invention.
Figure 3:
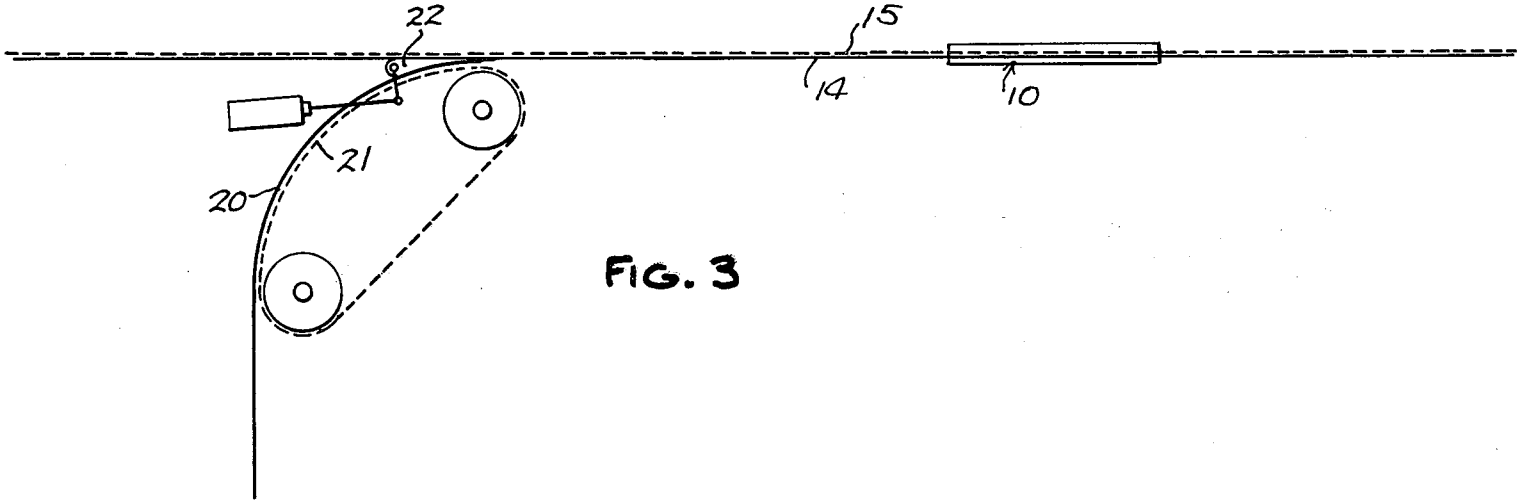
FIG. 3 is a partly diagrammatic plan view of a portion of the conveyor system.

Referring to FIGS. 1–3, a power and free conveyor system embodying the invention comprises a plurality of carriers 10 that include trolleys 11, 12 interconnected by a tie bar 13 and are movable along a free track 14 defined by side-by-side channel members.

A power conveyor chain 15 is suspended by chain trolley 16 from a power track 17. The chain 15 is driven by a drive, not shown, and includes a plurality of pushers 18 that engages a pusher dog 19 on the trolley 11 to push the carrier along the track 14. Such systems are well known and may include branch portions 20 of the free track as shown diagrammatically in FIG. 3 to which the carrier is delivered and then transferred by a transfer chain 21 along the free track. A diverter 22 may be used as is well known in the art.

Figure 4:
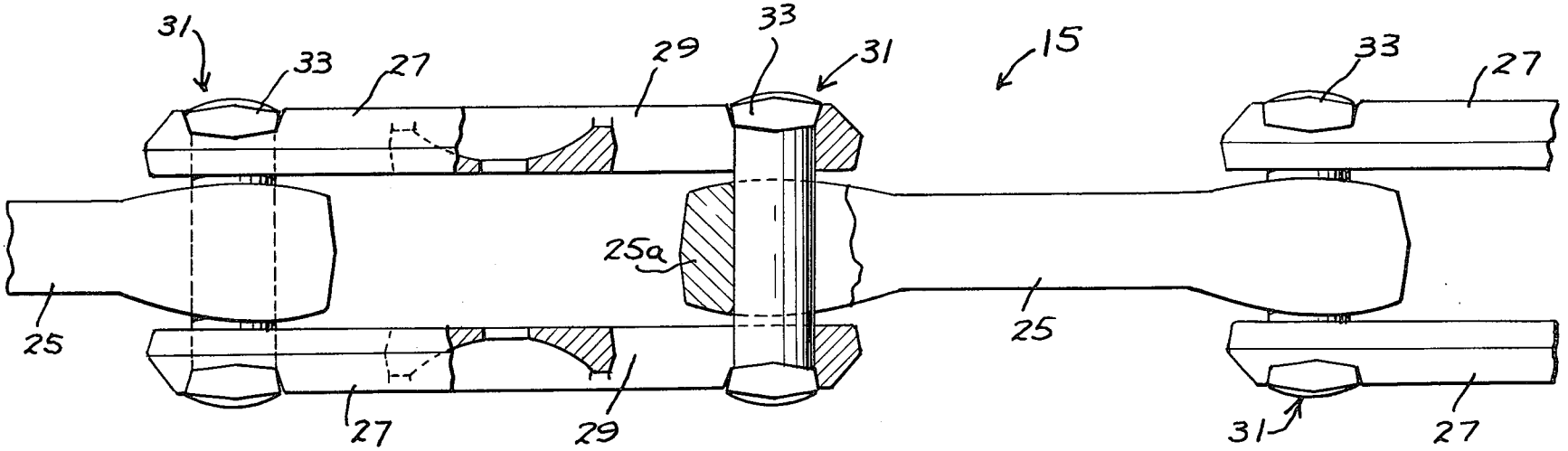
FIG. 4 is an enlarged fragmentary side elevational view of a portion of the conveyor chain shown in FIG. 1.

As shown in FIG. 4, the conveyor chain 15 comprises center or main links 25 having enlarged end portions 25*a* which have elongated openings or a single elongated opening 26 therethrough extending longitudinally thereof and opposed upper and lower side links 27, each of which also has elongated openings 29 in the opposed ends thereof. A pivot pin 31 is utilized for interconnecting links 27 with link 25 and comprises a cylindrical central portion 32 and enlarged T-shaped portion 33 having a greater length $L_1$ than width W. The length $L_1$ is less than the length $L_2$ of the openings 29 in the links 27 so that when the pivot pin is rotated 90° relative to the links, the pin and links can be disassembled. In the assembled relation, recesses 34 are provided into which the enlarged portions 33 of the pivot pin 31 extend and hold the chain in assembled relation.

Figure 9:
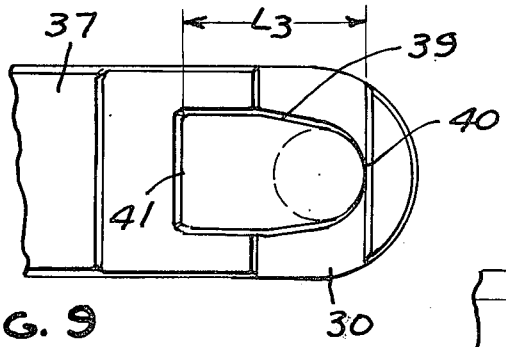
FIG. 9 is a fragmentary bottom plan view of the pusher dog link shown in FIG. 5.

In accordance with the invention, a modified link 35 is provided as one of the lower links 27 and includes an elongated body 36 and a downwardly extending pusher 37. The body 36 is similar in overall configuration to the links 27, except that the opening 38 in each end of the body has a length $L_3$ (FIG. 9) which is less than the length $L_1$ of the enlarged portion 33 of the pin 31. As shown in FIG. 9, the outermost end of each opening 38 is rounded as at 40 while the inner end is generally at a right angle as at 41.

Figure 5:
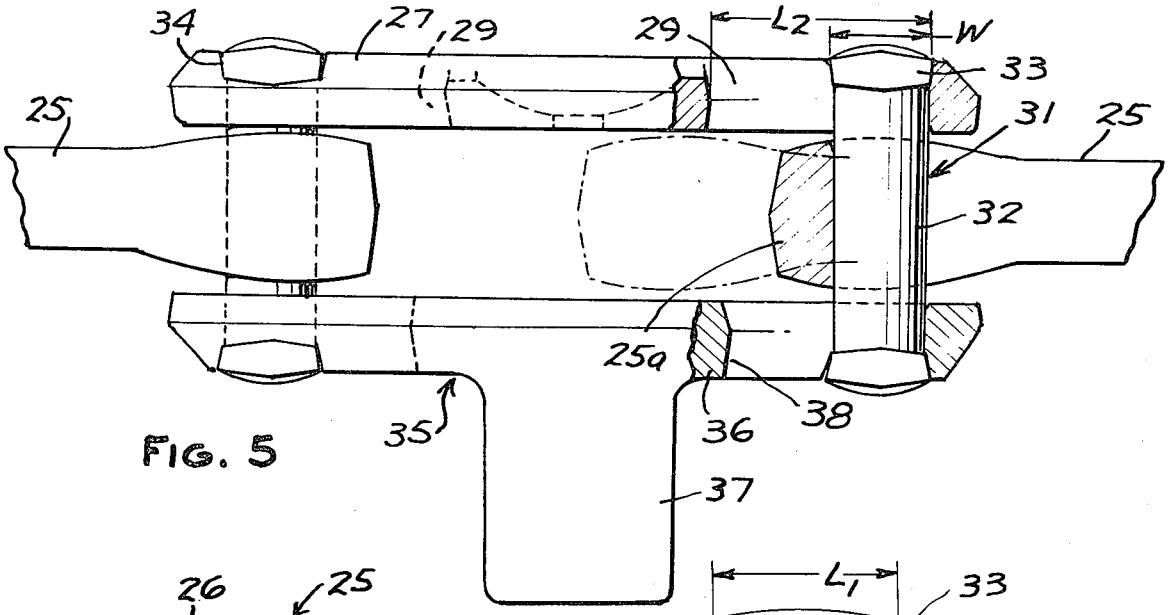
FIG. 5 is a fragmentary part sectional side elevational view on an enlarged scale of a portion of the conveyor chain.
Figure 7:
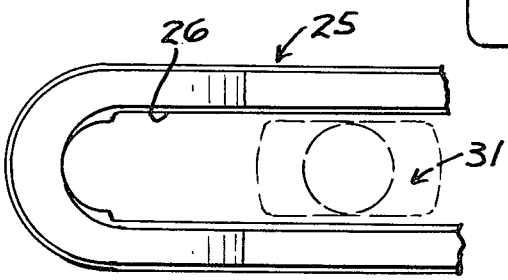
FIG. 7 is a fragmentary plan view showing the relative positions of the parts during another position for dis-assembly.
Figure 6:
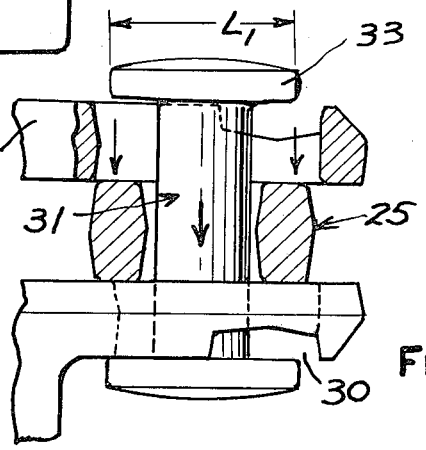
FIG. 6 is a fragmentary sectional view showing the parts in different operative positions.
Figure 8:
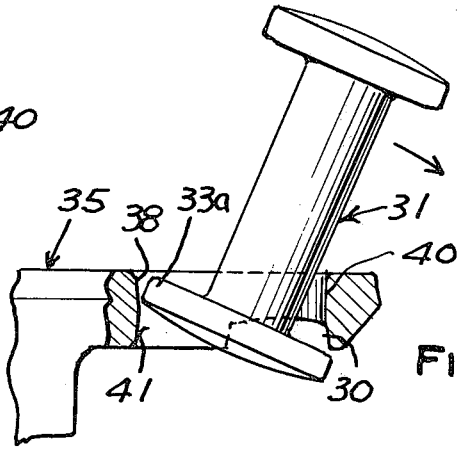
FIG. 8 is a fragmentary sectional view showing the relative positions of the parts during a still further portion of dis-assembly.

In order to dis-assemble the portion of the chain having the pusher 37 thereon, the links 25 are moved toward one another to the broken line position as shown in FIG. 5 and rotated at 90° to the links 27, 35. This permits the links 27, 35 to be moved toward one another since the enlarged portions 25*a* are thereby moved out from between the links 27, 35 as shown in FIG. 6 and the pin 31 can then be rotated to align the longer dimension $L_1$ thereof with the length $L_2$ of the openng 29 so that the link 27 can be lifted upwardly. The links 25 are then rotated 90° once again bringing the elongated portion of the pin 31 into alignment with the openings 26 of the main link 25 so that the links 26 can be removed by relative transverse movement leaving the pivot pin 31 in the opening 38 of the pusher dog link 35. The pivot pin 31 can then be removed only by a pivotal movement as shown in FIG. 8 bringing one end 33*a* past the surface 41 and swinging in a clockwise fashion. Since the other end of the opening 39 is rounded, the pin cannot be removed by swinging movement in the opposite direction. It has been found by this arrangement that the pusher link not only can be disassembled and assembled without the use of tools but has sufficient strength to withstand the forces upon the link during pushing and force engaging action of the conveyor chain with respect to the carrier.

Figure 10:
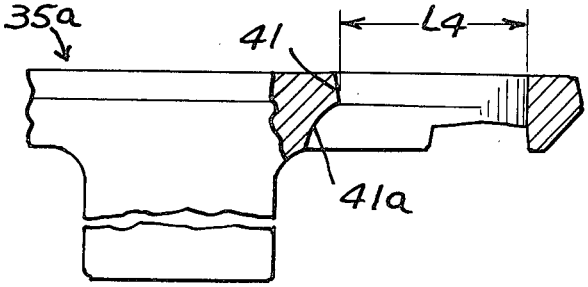
FIG. 10 is a part sectional fragmentary view of a modified form of pusher dog link.

In the form of the invention shown in FIG. 10, the inner surface 41 has the lower portion 41*a* cut away to facilitate dis-assembly permitting the length $L_4$ to be even less providing a greater mass in the pusher dog link 35*a*.

It can thus be seen that there has been provided a construction of a conveyor chain for power and free conveyors that permits removal of the pusher dog link without the use of tools, provides adequate strength for the pusher dog link in the limited space allowed because of clearance and the like.

I claim:

1. In a power and free conveyor system, the combination comprising load supporting means along which carriers are moved in a predetermined path, supporting means mounted along said load supporting means defining a conveyor chain supporting structure, and a conveyor chain supported by said supporting means comprising a plurality of substantially identical alternate main links, alternate pairs of substantially identical upper and lower links between said main links, each of said main and upper and lower links having longitudinally extending openings adjacent their ends having a greater length than width such that each opening has an axis extending longitudinally of its respective link, and a pivot pin interconnecting the main links and upper and lower links and comprising a central portion extending through the opening in the main links and an enlarged transverse portion extending transversely of the upper and lower links, said transverse portion having a longer dimension and a shorter dimension, said chain being disengageable without tools by rotation of the pin with respect to the openings in the links so that the enlarged end can be removed by relative movement of the opening in the links, at least some of said links having an integral pusher member extending outwardly intermediate the ends thereof, the length of each opening in the link having the pusher dog thereon being less than the longer dimension of the enlarged portion of the pin such that the pin can be removed with respect to the pusher dog only by a swinging movement with respect to the axis of its respective opening.

2. The combination set forth in claim 1 wherein the openings in said link having the pusher dog thereon are rounded in the plane of the link at the extreme end of the opening nearest the outer end.

3. The combination set forth in claim 1 wherein the link having the pusher dog thereon has the inner end of the opening nearest the pusher dog cut away.

4. The combination set forth in claim 1 wherein the ends of said main link are enlarged.

5. In a power and free conveyor system, the combination comprising a conveyor chain comprising a plurality of alternate main links, alternate pairs of upper and lower links between said main links, each of said main and upper and lower links having longitudinally extending openings adjacent their ends having a greater length than width such that each opening has an axis extending longitudinally of its respective link, and a pivot pin interconnecting the main links and upper and lower links and comprising a central portion extending through the opening in the main links and an enlarged transverse portion extending transversely of the upper and lower links, said transverse portion having a longer dimension and a shorter dimension, said chain being disengageable without tools by rotation of the pin with respect to the openings in the links so that the enlarged end can be removed by relative movement of the opening in the links, at least some of said links having an integral pusher member extending outwardly intermediate the ends thereof, the length of each opening in the link having the pusher dog thereon being less than the longer dimension of the enlarged portion of the pin such that the pin can be removed with respect to the pusher dog only by a swinging movement with respect to the axis of its respective opening.

6. The combination set forth in claim 5 wherein the openings in said link having the pusher dog thereon are rounded in the plane of the link at the extreme end of the opening nearest the outer end.

7. The combination set forth in claim 5 wherein the link having the pusher dog thereon has the inner end of the opening nearest the pusher dog cut away.

8. The combination set forth in claim 5 wherein the ends of said main link are enlarged.

* * * * *